United States Patent [19]

Kabanek

[11] Patent Number: 4,635,914

[45] Date of Patent: Jan. 13, 1987

[54] ORTHOPEDIC ATTACHMENT FOR SURGICAL TABLES

[76] Inventor: Joseph R. Kabanek, P.O. Box 156, Helotes, Tex. 78023

[21] Appl. No.: 693,999

[22] Filed: Jan. 23, 1985

Related U.S. Application Data

[63] Continuation-in-part of Ser. No. 567,770, Jan. 3, 1984, abandoned.

[51] Int. Cl.[4] ..... A61G 13/00

[52] U.S. Cl. ..... 269/328

[58] Field of Search ..... 269/15, 322, 323, 327, 269/328

[56] References Cited

U.S. PATENT DOCUMENTS

| | | | |
|---|---|---|---|
| 2,609,261 | 9/1952 | Parker | 269/327 |
| 4,045,011 | 8/1977 | Ford | 269/328 |
| 4,082,257 | 4/1978 | Strickland | 269/328 |
| 4,323,080 | 4/1982 | Melhart | 269/328 |

*Primary Examiner*—Frederick R. Schmidt
*Assistant Examiner*—Judy J. Hartman
*Attorney, Agent, or Firm*—Norvell & Associates

[57] ABSTRACT

A surgical tray attachment for expediting the performance of wound cleansing, surgical operations, and the taking of X-ray pictures of a patient's extremity while the patient is resting on a conventional surgical table. The tray is formed of an X-ray-transparent material and is of generally rectangular configuration projecting laterally relative to the surgical table and providing adequate room for a surgeon to function efficiently on either side of the tray. A clamp is provided for mounting the inboard end of the surgical tray to the support rail commonly provided on surgical tables. The medial portions of the tray are provided with a plurality of vertical passages for draining cleansing fluids from the surface of the tray. Depending lugs are provided on the underside of the tray for selectively mounting an X-ray film cartridge in contiguous relationship to the bottom surface of the tray, or alternatively, mounting a fluid-collecting trough for collecting fluids draining through the vertical passages and directing such fluids to a suitable receptacle.

8 Claims, 3 Drawing Figures

ORTHOPEDIC ATTACHMENT FOR SURGICAL TABLES

RELATIONSHIP TO OTHER PENDING APPLICATIONS

This application constitutes a continuation-in-part of my co-pending application Ser. No. 567,770, filed Jan. 3, 1984, abandoned.

BACKGROUND OF THE INVENTION

1. Field of the Invention:

The invention relates to a surgical tray attachment for expediting the performance of surgical operations on, and the taking of X-ray pictures of a patient's extremity while the patient is resting on a conventional surgical table.

2. History of the Prior Art:

The basic configuration of most surgical operating tables is designed for operations performed on the head or trunk of the body. Thus, the customary table is sufficiently narrow to support the trunk of the body and permits surgeons to stand on both sides of the table to perform the operation. When, however, surgery is required on an extremity such as an arm, hand, leg, or foot, the particular extremity can be positioned on the operating table, in fact, secured to the surface of the table if securement is desirable, but it is necessarily in an awkward position for those surgeons who must stand on the opposite side of the table from the particular extremity. Moreover, in repairing injuries to an extremity suffered in an accident, it is highly desirable that the extremity be thoroughly flushed with an appropriate sterile cleaning fluid to remove foreign matters from the wound and reduce the risk of infection. If the flushing operation is performed on the surgical table, an obvious mess results. On the other hand, if the extremity is moved to permit the flushing operation to be accomplished while the extremity is positioned off the table, there is an obvious risk of providing improper support to the extremity during the flushing or cleaning operation.

Additionally, it is often desirable that one or more X-rays be taken prior to the operation and as the operation proceeds, particularly where multiple fractures are involved or where bone splinters must be removed from the extremity. While portable X-ray machines are a standard fixture in a modern operating room, it still generally requires that the extremity being operated on be moved off the operating table so that it may be positioned between the beam-emitter portion of the X-ray machine and the X-ray film cartridge. Such movement during the course of an operation is very undesirable and often results in irreputable damage to the patient. There is, therefore, a definite need for an accessory table or tray attachable to a surgical table for facilitating the washing of a patient's extremity, the X-raying of such extremity, and surgical operations on the extremity.

SUMMARY OF THE INVENTION

In my above-referred-to co-pending application, there is disclosed a tray-like attachment for surgical table which is specifically designed to support a patient's extremity for the expedient performance of surgical and/or X-ray operations thereon. The tray is formed from rigid X-ray-transparent material, such as polycarbonate, and is of generally rectangular configuration.

Along one of the short edges, clamping means are provided for rigidly securing that end of the tray in cantilevered relation to a supporting bar normally provided along the side of the surgical table at a position generally parallel with the patient-supporting surface, so that the patient's extremity may be securely fastened to the medial portion of the tray. While not necessary, the outboard end of the orthopedic tray may be provided with an adjustable floor-engaging means for more firmly supporting the orthopedic tray. The long sides of the tray are preferably provided with inwardly curved sections to better accommodate the body of the surgeon who may take a position on either side of the extremity and have better access to the portion thereof undergoing the surgical treatment.

The underside of the medial portion of the orthopedic tray is provided with apparatus for detachably securing an X-ray film cartridge in parallel, juxtaposed relationship to the undersurface of the X-ray-transparent tray, and thus in an ideal position to receive the X-rays being transmitted by an X-ray machine above the tray through the patient's extremity and into the film cartridge. The aforedescribed orthopedic tray did not, however, provide facilities for effecting the flushing of the patient's extremity with a sterile cleaning solution as a preliminary to, or part of the surgical operation. In accordance with this invention, an orthopedic tray attachment of the general type described in my above-mentioned copending application is provided with a plurality of vertical passages in the medial portions of the tray, extending through the thickness of the tray and permitting ready drainage from the tray of any fluids applied to the patient's extremity which is supported on the orthopedic tray.

Support lugs are provided along one edge of the bottom surface of the tray at a location outside of all of the fluid passages, and a manually operable clamping element is provided on the opposite side of the fluid passages from the support lugs. The support lugs are contoured to accept either one edge of an X-ray film cartridge or one edge of a fluid-collecting trough. Similarly, the manually operable clamping element is constructed to effect a clamping action on either the other edge of the X-ray film cartridge or the other edge of the fluid-collecting trough.

Thus, when fluid-washing operations are being performed, the surgical attendants can quickly clamp a collecting trough beneath the orthopedic tray and fluids applied to the patient's extremity will flow through the vertical passages into the collecting trough, from which they may be directed into a suitable receptacle through an aperture provided in the bottom portions of the collecting trough. When there is no further need for fluid-washing operations, the collecting trough may be removed from its clamped position relative to the orthopedic tray and an X-ray film cartridge clamped into position using the same support lugs and manually operable clamping mechanism as was utilized to secure the fluid-collecting trough to the tray.

In this manner, a high degree of flexibility is provided for the surgeon faced with operating on a wound in a patient's extremity. Without moving the extremity from the support tray, the extremity may be washed, X-rayed, and then operated on without disturbing the position of the extremity on the orthopedic tray attachment and without accumulating a puddle of washing fluid on either the tray surface or on the floor adjacent the operating area.

Further advantages of the invention will be readily apparent to those skilled in the art from the following detailed description, taken in conjunction with the annexed sheet of drawings, on which is shown a preferred embodiment of the invention.

DESCRIPTION OF PREFERRED EMBODIMENT

Figure 1:
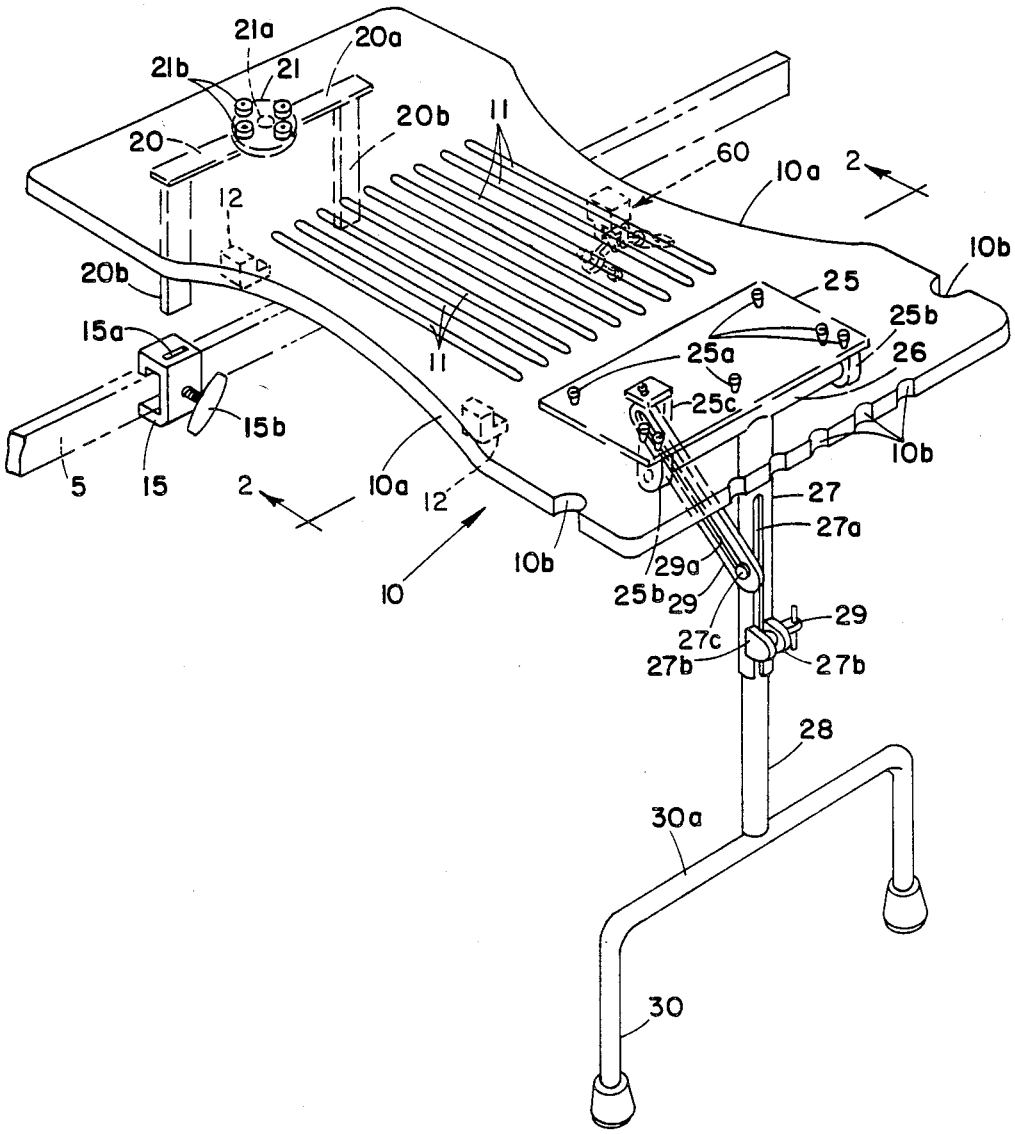
FIG. 1 is a partially exploded perspective view of an orthopedic tray attachment for a surgical table embodying this invention.
Figure 3:
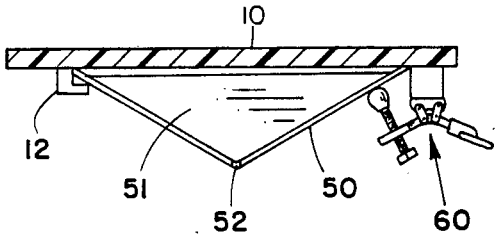
FIG. 3 is a view similar to FIG. 2, but showing the mounting of a fluid-collecting trough beneath the orthopedic tray.
Figure 2:
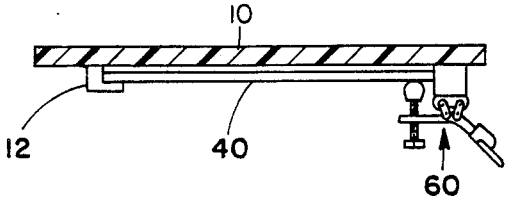
FIG. 2 is a sectional view taken on the plane 2—2 of FIG. 1, showing an X-ray film cartridge mounted beneath the orthopedic tray.

Referring to FIGS. 1–3, there is shown an operating tray-table 10 embodying this invention. The tray 10 is of generally rectangular configuration and is normally disposed adjacent to a surgical table (not shown) upon which the patient's body is resting. As is customary for such surgical tables, they are provided with a longitudinally extending bar 5 extending the length of each movable section of the surgical table at a level below and parallel to the patient support surface of the surgical table.

The tray 10 is firmly supported on the surgical table support bar 5 by a pair of C-shaped clamps 15 which encircle the support bar 5 and are each provided with a vertically extending slot 15*a* for receiving therein the leg portions 20*b* of an inverted U-shaped frame 20. A manually operable clamping bolt 15*b* effects the rigid interengagement of the clamps 15, the support bar 5, and the leg portion 20*b*.

The U-shaped frame 20 has a horizontally disposed bight portion 20*a* which is traversed by pivot bolt 21*a* which is secured in depending relationship to a circular disc 21. Thus, pivotal movement of the tray in a horizontal plane is accommodated by the aforedescribed mounting structure.

To provide additional rigidity to the cantilever-supported tray, the outboard end of the tray 10 has a support plate 25 secured to its undersurface by a plurality of bolts 25*a*. Support plate 25 in turn supports a pair of laterally spaced depending lugs 25*b* which journal a pivot mounting shaft 26. A vertical support tube 27 is rigidly secured, as by welding, to the central portion of the shaft 26 and projects downwardly in surrounding, clamping relationship to an upstanding support tube 28, which in turn is welded at its bottom end to the middle of the bight portion 30*a* of an inverted U-shaped floor-engaging support 30. The lower portion of the vertical support tube 27 is axially slit as indicated at 27*a* and a pair of lugs 27*b* are secured to opposite sides of the slit 27*a* and are drawn into clamping relationship to the support post 28 by a manually operable clamping bolt 29. Thus, the desired height of the tray 10, corresponding to the vertical position of the operating table support bar 5, may be conveniently accommodated by the telescopic connection between the depending support tube 27 and the upstanding support post 28. A diagonal brace 29 is secured to plate 25 by a bracket 25*c* and has an elongated slot 29*a* with a lateral extension (not shown) engaging a pin 27*c* on support tube 27 to detachably secure the floor-engaging structure in the illustrated position.

As is readily apparent from FIG. 1, the tray 10 embodying this invention is of generally rectangular configuration with the length axis of the tray being disposed in transverse relationship to the length axis of the surgical table (not shown). On each of the longitudinal edges of the tray 10 there is provided a reentrant section 10*a* to better accommodate the body of the surgeon who may be working on the patient on either side of tray 10. Along the outboard edges of the tray 10 there is provided a plurality of spaced notches 10*b* to accommodate cords (not shown) which are attached in conventional fashion between the fingers, toes, or other portions of the patient's extremity and support weights to maintain the patient's extremity in a desired position on the table 10.

In order to facilitate the taking of X-ray pictures of the patient's extremity, the tray 10 is formed from a rigid material which is transparent to X-rays. A plastic material, such as a rigid polycarbonate or a fiberglass-reinforced, thermosetting plastic is suitable for this purpose.

The construction of tray 10 thus far described is substantially similar to that described in my aforementioned copending application. In accordance with this invention, in order to accommodate flushing or similar cleaning operations performed by applying fluids to the patient's extremity, the support tray 10 is provided with a plurality of vertical passages 11 traversing most of the operating area of the tray 10. For example, the vertical passages 11 may comprise a series of parallel slots which are disposed in closely spaced relationship across the medial portion of the tray 10 and extend in generally parallel relationship to the length dimension of the tray. Other configurations of slots may of course be utilized, as the only essential requirement is that the tray surface immediately adjacent to a supported extremity and beneath such extremity is provided with sufficient vertical passages to immediately drain any fluids applied to the extemity which flow onto the tray surface.

On the underside of the tray 10, a pair of depending lugs 12 are mounted by adhesive or suitable bolts (not shown). These lugs are disposed in generally parallel relationship to the length axis of the tray 10 and are disposed adjacent the one longitudinal edge of the tray. The lugs 22 are configured so as to selectively engage either one edge of an X-ray film cartridge 40, as shown in FIG. 3, or one edge of a fluid-collecting trough 50. An L-shaped configuration, as illustrated, is suitable as shown in FIG. 2. The opposite edge of the X-ray film cartridge 40, or the trough 50, as the case may be, is secured to the underside of tray 10 by a manually operable, over center toggle latch 60 of conventional construction.

The trough 50 may be conveniently formed of rigid plastic material and may, if desired, be provided with partial or full end walls 51. In any event, the trough 50 serves to collect fluids draining through the vertical fluid passages 11 provided in the tray 10. If a substantial amount of such fluids is to be collected, the trough 50 may be provided with an aperture 52 in its bottom portion to direct the collected fluids to a suitable receptacle which may be placed on the floor beneath the tray 10.

It will be readily apparent to those skilled in the art that this invention provides an orthopedic operating tray attachment for a surgical table which affords the utmost flexibility to the operating room personnel. An extremity may be placed on the table and secured in a desired position and flushing or cleaning operations of a wound in the extremity may be performed, with the surplus fluids being collected in the trough 50 and directed to a suitable receptacle. The through 50 may be rapidly removed from its clamped position beneath the tray 10 and an X-ray film cartridge 40 substituted therefore, in order to permit X-rays of the patient's extremity to be taken. Lastly, surgical operations may be more conveniently accomplished on the extremity, particularly by a pair of surgeons, because ready access to the extremity from either side of the operating tray 10 is provided.

Although the invention has been described in terms of a specified embodiment which is set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An orthopedic attachment for surgical table having a patient-supporting surface and a rigid bar extending along one side of the surfical table parallel to the patient-supporting surface, comprising, in combination: a tray formed of rigid X-ray-transparent material, the tray having top and bottom surfaces, opposed ends, first and second edges connecting said ends, and a medial portion intermediate said first and second edges; means secured to said tray adjacent one end thereof for detachably securing said tray to said rigid bar, said securing means including means for orienting the tray so that said first and second edges project laterally relative to the patient-supporting surface whereby a patient's extremity may be supporting on said tray for surgical operations performed from either edge of said tray and for X-ray pictures of the extremity without moving the extremity; said tray having a plurality of vertical pasages through the medial portion thereof; at least one support lug depending from the bottom of said tray at a location outside of said vertical passages, said support lug being contoured to receive and selectively support either one edge of an X-ray film cartridge or an edge of a fluid-collecting trough; and manually operable latch means positioned on said tray bottom on the opposite side of said vertical passages for said support lug; the latch means having an engaging portion for selectively engaging either another edge of the X-ray film cartridge or the other edge of the trough, whereby either an X-ray film cartridge or a fluid-collecting trough may be selectively clamped between the lug and latch means beneath said tray.

2. The orthopedic attachment of claim 1 further including at the second edge of the tray a plurality of notches for positioning tensioning lines attached to the patient's extremity.

3. An orthopedic attachment for a surgical table having a patient-supporting surface and a rigid bar extending along one side of the surgical table parallel to the patient-supporting surface, the attachment comprising, in combination: a tray formed of a rigid X-ray-transparent material, a trough having first and second opposed edges and an X-ray film cartridge also having first and second opposed edges; the tray having a medial portion and a bottom surface, means secured to said tray adjacent one edge thereof for detachably securing the tray, to said rigid bar to project laterally relative to the patient-supporting surface wherein a patient's extremity may be securely supported on said tray for surgical operations performed from either side of said tray and for making X-ray pictures of the extremity without moving the extremity; and tray having a plurality of vertical passages through the medial portions thereof; at least one support lug depending from: the bottom of said tray at a location outside of said vertical passages, said support lug being contoured to receive and selectively support either the first edge of the X-ray film cartridge or the first edge of the fluid-collecting trough; and a manually operable latch means positioned on said tray bottom on the opposite side of said vertical passages from said support lug; the latch means having an engaging portion for selectively supporting either the second edge of the X-ray film cartridge or the second edge of the trough, whereby either the X-ray film cartridge or the fluid-collecting trough may be selectively clamped beneath said tray bottom surface.

4. The orthopedic attachment of claim 3 wherein the tray has a flat operating surface and wherein the plurality of vertical passages extending therethrough are distributed across substantially the entire medial portion, wherein fluids drain immediately from the surface of the table.

5. The orthopedic attachment of claim 3 wherein there are a plurality of support lugs spaced from one another, wherein each of the support lugs is L-shaped in cross section defining a slot with the bottom surface of the table to receive the first edge of either the trough or the X-ray film cartridge; and wherein the latching means includes a pivoted member having the engaging portion thereon for abutting either the trough or the X-ray film cartridge adjacent the second edges thereof.

6. The orthopedic attachment of claim 3 further including at the opposite edge thereof a plurality of spaced notches for positioning tensioning lines attached to the patient's extremity.

7. The orthopedic attachment of claim 3 further including a support leg pivoted to the tray at a location adjacent to the opposite end thereof for engaging a floor to support the opposite end of the tray.

8. An orthopedic attachment for a surgical table having a patient-supporting surface and a rigid bar extending along one side of the surgical table parallel to the patient-supporting surface, the attachment comprising, in combination: a tray formed of a rigid X-ray-transparent material, a trough having first and second edges and an X-ray film cartridge also having first and second edges; the tray having a medial portion and a bottom surface, means secured to said tray adjacent one edge thereof for detachable securing the tray to said rigid bar to project laterally relative to the patient-supporting surface wherein a patient's extremity may be securely supported on said tray for surgical operations performed from either side of said tray and for making X-ray pictures of the extremity without moving the extremity; said tray having a plurality of vertical passages through the medial portions thereof; support means depending below the bottom surface of said tray at a location outside of said vertical passages, said support means being contoured to selectively receive and support either the first edge of the X-ray film cartridge or the first edge of the fluid-collecting trough; and a manually operable latch means depending below said tray bottom surface and disposed outside of said vertical passages; the latch means having an engaging portion for selectively engaging either the second edge of the X-ray film cartridge or the second edge of the trough, whereby either the X-ray film cartridge or the fluid-collecting trough may be selectively clamped beneath said tray bottom surface.

* * * * *